US010704834B2

(12) United States Patent
Ojalainen

(10) Patent No.: US 10,704,834 B2
(45) Date of Patent: Jul. 7, 2020

(54) JET BOX AND A DRYER USING THE SAME

(71) Applicant: RAUTE OYJ, Nastola (FI)

(72) Inventor: Jussi Ojalainen, Lahti (FI)

(73) Assignee: RAUTE OYJ, Nastola (FI)

( * ) Notice: Subject to any disclaimer, the term of this patent is extended or adjusted under 35 U.S.C. 154(b) by 106 days.

(21) Appl. No.: 15/751,037

(22) PCT Filed: Sep. 6, 2016

(86) PCT No.: PCT/FI2016/050618
§ 371 (c)(1),
(2) Date: Feb. 7, 2018

(87) PCT Pub. No.: WO2017/042433
PCT Pub. Date: Mar. 16, 2017

(65) Prior Publication Data

US 2018/0231310 A1 Aug. 16, 2018

(30) Foreign Application Priority Data

Sep. 7, 2015 (FI) ..... 20155640

(51) Int. Cl.
*D06F 58/22* (2006.01)
*F26B 21/00* (2006.01)
*F26B 15/12* (2006.01)

(52) U.S. Cl.
CPC ..... *F26B 21/004* (2013.01); *F26B 15/12* (2013.01); *F26B 2210/14* (2013.01)

(58) Field of Classification Search
CPC ..... F26B 21/004; F26B 21/006; F26B 15/12; F26B 2210/14
(Continued)

(56) References Cited

U.S. PATENT DOCUMENTS 3,453,743 A 7/1969 Hale
4,074,841 A * 2/1978 Kramer ..... B65H 23/24 226/97.3
(Continued)

FOREIGN PATENT DOCUMENTS

DE 975015 C 7/1961
EP 2869011 A1 5/2015
(Continued)

OTHER PUBLICATIONS

FI Search Report, dated Mar. 3, 2016, from corresponding FI application No. 20155640.
(Continued)

*Primary Examiner* — John P McCormack
(74) *Attorney, Agent, or Firm* — Young & Thompson

(57) ABSTRACT

Disclosed is a jet box for guiding an incoming air flow in drying of a veneer sheet. The jet box includes at least one jet nozzle. The jet nozzle includes a guide surface forming a three dimensional opening structure, which is limited at its first end to an inner opening and at its second end to an outer opening. The guide surface includes a first portion and a second portion, wherein the first portion substantially on a side of the incoming air flow is convexly curved outwards from the jet box and the second portion substantially on the opposite side of the opening structure in relation to the incoming air flow is concavely curved outwards from the jet box. Also disclosed is a dryer including at least one jet box.

13 Claims, 4 Drawing Sheets

(58) Field of Classification Search
USPC ..... 34/487, 492, 510, 424, 413, 428
See application file for complete search history.

(56) References Cited

U.S. PATENT DOCUMENTS

| | | | |
|---|---|---|---|
| 4,551,926 | A | 11/1985 | Aufderhaar |
| 5,839,207 | A | 11/1998 | Christensen et al. |

FOREIGN PATENT DOCUMENTS

| | | | |
|---|---|---|---|
| GB | 563962 | A | 9/1944 |
| GB | 1236547 | A | 6/1971 |
| JP | S51-31167 | U | 3/1976 |
| JP | 2013-067081 | A | 4/2013 |
| SU | 427216 | | 4/1972 |
| SU | 580421 | | 5/1975 |
| WO | 2004/101238 | A2 | 11/2004 |
| WO | 2013/172777 | A1 | 11/2013 |

OTHER PUBLICATIONS

International Search Report, dated Dec. 23, 2016, from corresponding PCT application No. PCT/FI2016/050618.
Russian Search Report for Application No. 2018107653, dated Feb. 1, 2019.
Office Action for Japanese Patent Application No. 2018-509511 dated Aug. 27, 2019 with English translation provided.

* cited by examiner

JET BOX AND A DRYER USING THE SAME

TECHNICAL FIELD

The invention concerns in general a technical field of heat transfer. Especially the invention concerns heat transfer solution for drying of sheet-like products.

BACKGROUND

There are several manufacturing processes in wood industry and other industries wherein products manufactured need to be dried at some stage of the process. The products are typically sheet-like products, such as paper, plasterboard or veneer sheets, for example. In the following it is mainly referred to veneer production.

Veneers used in the plywood or laminated veneer lumber manufacturing process are dried using a drying apparatus in order to achieve the level of a moisture defined by the gluing requirements. Before the gluing, the moisture of the veneer may be, e.g., less than 10 percent in order to succeed in the gluing process. Too high moisture may cause delamination in the glue line, because the high steam pressure prevents the formation of the glue line and causes eruption of the steam.

The veneer sheets may be dried using, e.g., sun drying or contact drying. Generally, in industrial manufacture of the plywood dryers based on convection heat transfer, such as roller dryer or screen dryer, are used. Roller dryer and screen dryer are similar to each other in terms of the air flow. In roller dryer the veneer sheets travel between rollers and the rollers are supported by a supporting structure. In the screen dryer, in turn, the veneer sheets travel between the screens reside above and below the veneer sheets and the screens are supported by the rollers. In both dryers air is used to transfer the heat so that the hot air is blown with circulation blowers against the veneer sheets by means of a jet box. The efficiency, i.e. drying capacity as well as energy efficiency, of the drying may be tuned by changing the temperature and/or moisture of the drying air. Typically air is heated by blowing it through the heat exchangers that are heated with thermal oil or steam or in some cases also with water and/or other heat transfer fluids. Alternatively or in addition, the dryer is heated with burners operating with a natural gas, butane, or heavy fuel oil and the flue gas of the burners mix with the air circulated by the circulation blower.

In modern dryers these blowers are mostly radial blowers. In some cases and in older dryer models axial blowers are commonly used Generally, a structure of a dryer includes a drying chamber having an input end and an output end and a conveyor that conveys the veneer sheets to be dried through the drying chamber. The chamber includes heating unit sections having at least one jet box to transfer the heat against the veneer sheets to be dried. A cooling section cools the veneer sheets leaving the output end of the drying chamber. Cooling is done to prevent too warm veneers to enter the lay-up line. If veneers are too warm, the glue applied onto to the veneer in lay-up line will dry out before the veneer lay-up is pre pressed and hot pressed. In modern veneer dyers the cooling section includes a pressure controller for maintaining the required pressure difference between the drying chamber and the cooling section.

The evenness of the drying result in the width direction of the dryer, i.e., in the longitudinal direction of the jet box, may be affected, e.g., with the shaping of the jet box. The jet box may be cone-shaped in the longitudinal direction in order to achieve even drying result along the width of the whole dryer. In this manner the pressure inside the jet box may be arranged as constant as possible along the width of the whole dryer and the air flow from each jet nozzle of the jet box may be retained as similar with each other as possible. The efficiency and the evenness of the heat transfer may be tuned by changing, e.g., the conicity of the jet box, the size of the jet nozzle, the shape of the jet nozzle, and/or the distance between the jet nozzles.

Generally speaking, the more even and efficient the heat transfer is, the more effective and efficient the drying is. Improving the heat transfer allows using smaller dryers to get the same production volume than with bigger dryers or improves the production volumes of the similar size dryer compared to the dryer with lower heat transfer capacity. The enhancing of the heat transfer reduces also the characteristic electric energy consumption, because less air circulation is needed to achieve the same heat transfer. This also applies to moisture transfer.

As mentioned above, the shape of the jet nozzle affects the efficiency of the jet box. A simple solution to realize the jet nozzle is to use a simple opening, but it is not the most efficient way. Thus, several different shapes of jet nozzles have been established and FIGS. 1*a*-1*e* illustrate some example solutions of the prior art jet nozzles such as flat opening (FIG. 1*a*), fingernail opening (FIG. 1*b*), flat slot opening (FIG. 1*c*), arc style opening (FIG. 1*d*), and orifice profile (FIG. 1*e*).

One drawback of the prior art solutions is that the jet nozzle may not be able to guide the air flow direction efficiently enough, thus the longitudinal incoming air flow is turned obliquely in respect to the incoming air flow and the surface of the veneer sheet. The same challenge also exists in a production of other sheet-like products, which needs to be dried. When the jet nozzle turns the air flow obliquely in respect to the incoming air flow and the surface of the veneer sheet, the guided air flows of the sequential jet nozzles in the longitudinal direction of the jet box may disturb each other, which in turn cause decreasing of the heat transfer.

Some of the prior art solutions could be improved to guide the air better, but that would cause more pressure loss in the jet nozzle. Increased pressure loss would mean need for more circulation blower power and need for higher pressures in the jet box. The higher power demand increases the electricity consumption and thus also the costs are increased. Hence, there is need to develop the existing solutions further in order to improve the efficiency of drying.

SUMMARY

An objective of the invention is to present a jet box and a dryer for a heat transfer solution for drying of sheet-like products. Another objective of the invention is that the jet box and the dryer improve the efficiency of the heat transfer and thus also the efficiency of drying.

The objectives of the invention are reached by a jet box and a dryer as defined by the respective independent claims.

According to a first aspect, a jet box for guiding an incoming air flow in drying of a veneer sheet is provided, wherein the jet box comprising at least one jet nozzle arranged on a base surface, the jet nozzle comprising a guide surface forming a three dimensional opening structure, which is limited at its first end to an inner opening and at its second end to an outer opening, the guide surface comprising a first portion of the guide surface and a second portion of the guide surface, wherein the first portion of the guide surface substantially on a side of the incoming air flow is convexly curved outwards from the jet box and the second portion of the guide surface substantially on the opposite side of the opening structure in relation to the incoming air flow is concavely curved outwards from the jet box.

The first portion of the guide surface may be configured to merge to the second portion of the guide surface gradually. Alternatively, the first portion of the guide surface may be configured to merge to the second portion of the guide surface so that the guide surface further comprises a first merging portion and a second merging portion between the first portion of the guide surface and the second portion of the guide surface.

Additionally, the first merging portion may be a planar surface or a line-like. Also the second merging portion may be a planar surface or a line-like.

The convexity of the first portion of the guide surface may be at least partly constant and/or varies progressively at least partly. In addition, the concavity of the second portion of the guide surface may be at least partly constant and/or varies progressively at least partly.

Alternatively or in addition, the outer opening may be circular, elliptical or oval. Also the inner opening may be circular, elliptical or oval.

The at least one jet nozzle may be arranged on the base surface of the jet box so that the guide surface further comprising an intermediate portion, which is bended at least partly inside or outside the jet box so that the intermediate portion of the guide surface diverges from the plane of the base surface of the jet box.

Moreover, the ratio of the diameter of the inner opening to the diameter of the outer opening may be between 1.3 and 4.0 and the ratio of the distance between the inner opening and the outer opening to the diameter of the outer opening may be between 0.25 and 1.4.

According to a second aspect, dryer for veneer production, comprising a blower is provided, wherein the dryer further comprising at least one jet box as defined above.

The exemplary embodiments of the invention presented in this patent application are not to be interpreted to pose limitations to the applicability of the appended claims. The verb "to comprise" is used in this patent application as an open limitation that does not exclude the existence of also un-recited features.

The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1A:
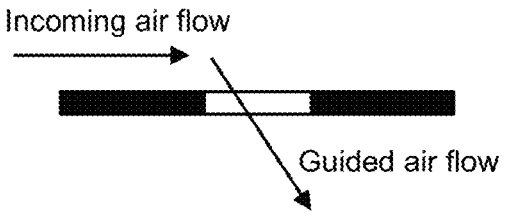
FIGS. 1*a*-1*e* illustrate schematically examples of jet nozzle according to prior art.
Figure 1B:
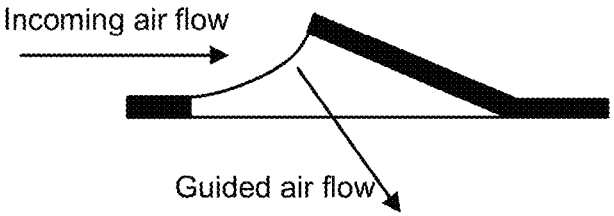
Figure 1C:
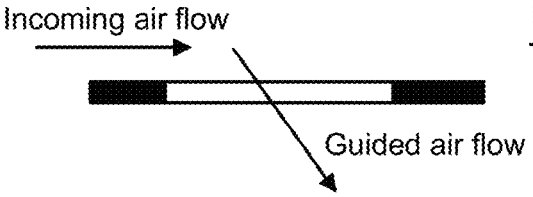
Figure 1D:
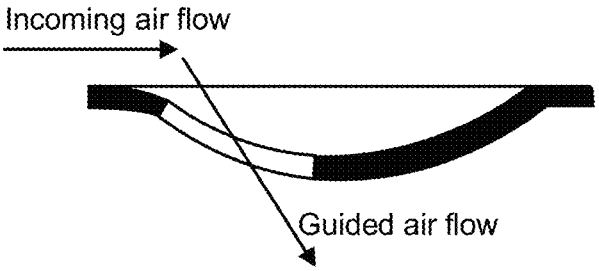
Figure 1E:
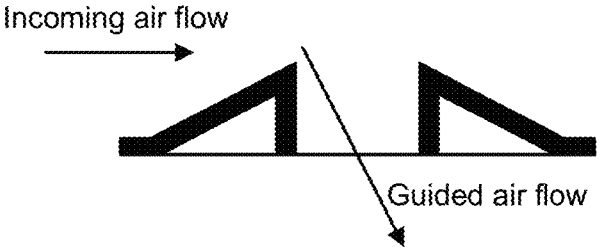
FIG. 1e PRIOR ART
Figure 2:
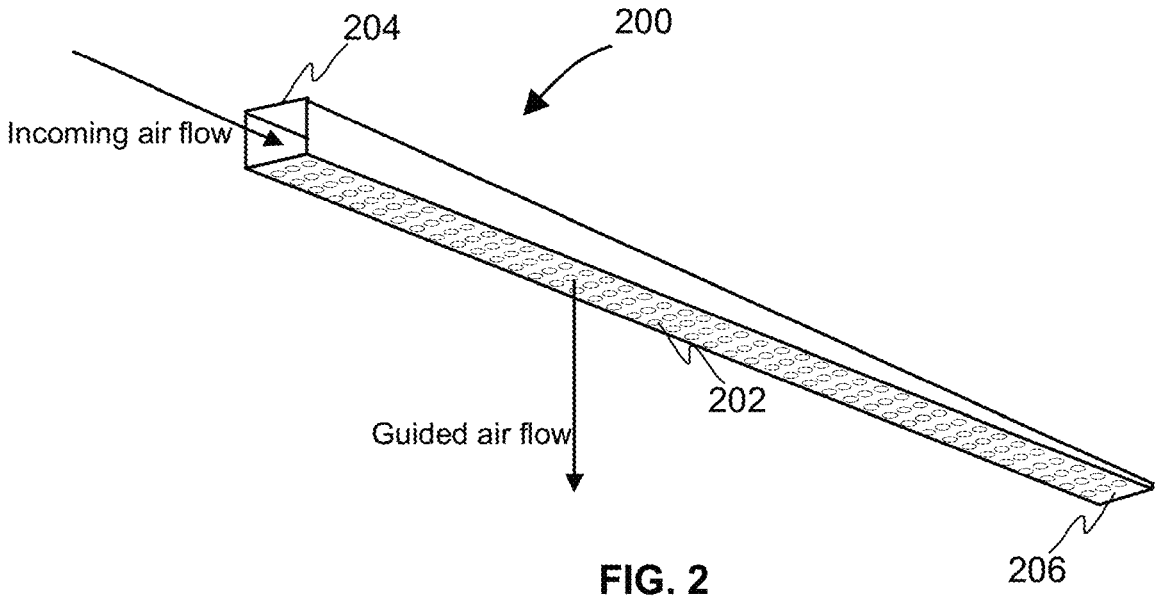
FIG. 2 illustrates schematically an example of a jet box according to the invention.

The present invention relates to a shape of a jet nozzle for establishing a novel jet box structure and a dryer for veneer production. FIG. 2 illustrates an example of the jet box 200 according to the present invention comprising a base surface 206, wherein at least one jet nozzle 202 is arranged, and at least one other surface 204 to enclose the jet box 200. An incoming air flow is arranged to flow inside the jet box 200 and the at least one jet nozzle 202 is configured to guide the direction of the longitudinal incoming air flow to substantially perpendicular to the base surface 206 of the jet box 200 against a veneer sheet (not shown in FIG. 2) travelling outside the jet box 200. Next, the invention is described in an implementation wherein the base surface 206 of the jet box 200 is arranged substantially parallel to the veneer sheet. The distance between the jet nozzles 202 may be defined so that the efficiency of a drying process of the veneer sheet may be optimized. The material of the jet box 200 may be, e.g., mild steel, aluminium, stainless steel, or acid-proof steel.

Figure 3:
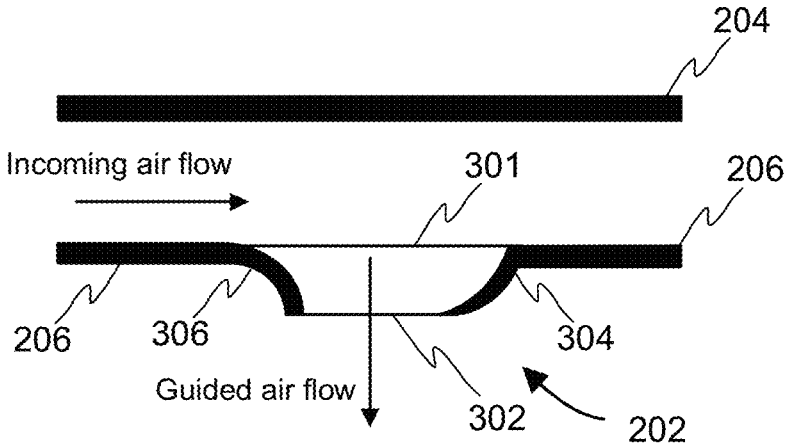
FIG. 3 illustrates schematically an example of a cross-sectional view of a jet nozzle according to the invention as viewed in a A-A direction of FIGS. 4*a* and 4*b*.

FIG. 3 illustrates a cross-sectional view of an example of the at least one jet nozzle 202 arranged on a base surface 206 of the jet box 200 according to the present invention. The jet nozzle 202 comprises a guide surface forming a three dimensional opening structure, which is limited at its first end to an inner opening 301 and at its second end to an outer opening 302. The guide surface comprises a first portion of the guide surface 306 and a second portion of the guide surface 304, wherein the first portion of the guide surface 306 substantially on a side of the incoming air flow is convexly curved outwards from the jet box 200 and the second portion of the guide surface 304 substantially on the opposite side of the opening structure in relation to the incoming air flow is concavely curved outwards from the jet box 200. The direction of the convexity of the first portion 306 of the guide surface and the direction of the concavity of the second portion of the guide surface 304 are from inside the jet box 200 to outside the jet box 200.

Figure 4A:
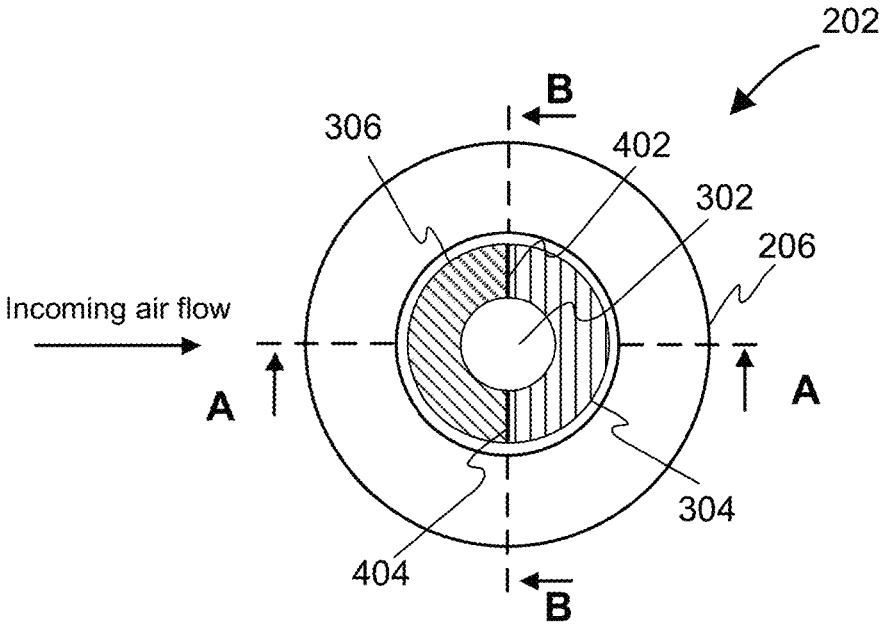
FIGS. 4*a* and 4*b* illustrate schematically examples of a top view of a jet nozzle according to the invention.
Figure 4B:
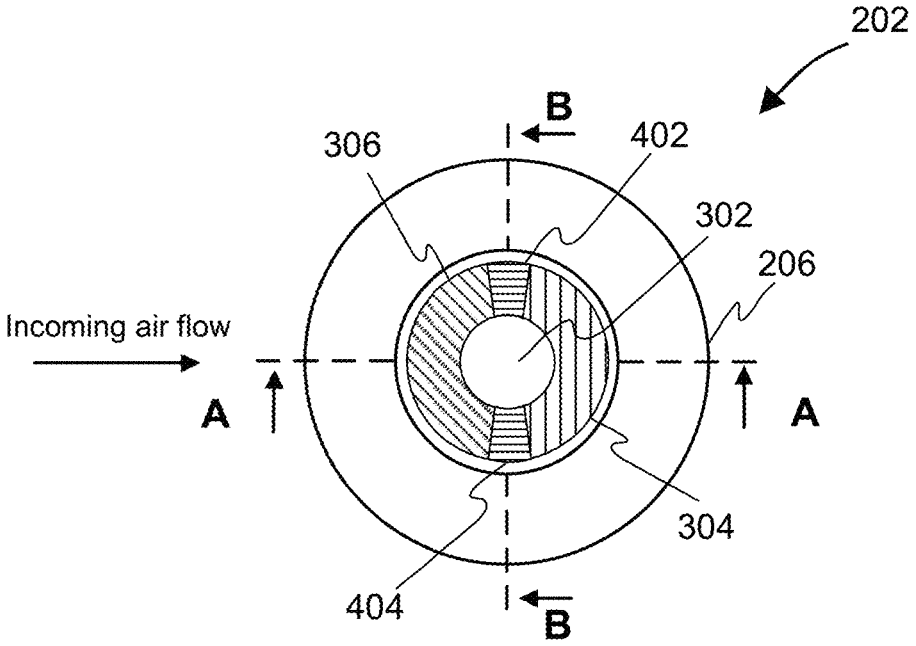

According to an example of the invention the first portion of the guide surface 306 may be configured to merge to the second portion of the guide surface 304 smoothly i.e. gradually. Alternatively, the first portion of the guide surface 306 may be configured to merge to the second portion of the guide surface 304 so that guide surface further comprises a first merging portion 402 and a second merging portion 404 between the first portion of the guide surface 306 and the second portion of the guide surface 304, wherein the merging portion 402, 404 may be a planar surface or a line-like. FIG. 4*a* shows a top view of the example jet nozzle 202 according to the present invention, wherein the merging portions 402, 404 are lines and the first portion of the guide surface 306 and the second portion of the guide surface 304 cover each 180 degrees of the surface of the guide surface. The merging portions 402, 404 illustrated in the example of the invention as shown in FIG. 4*b* are planar surfaces. The shape of the outer opening 302 in FIGS. 4*a* and 4*b* is preferably circular, but the shape of the outer opening 302 may also be elliptical or oval. Also the inner opening 301 may be circular, elliptical, or oval.

Advantageously, the diameter of the inner opening 301 is larger than the outer opening 302. The diameters of the inner opening 301 and the outer opening 302 may especially be defined so that the ratio of the diameter of the inner opening 301 to the diameter of the outer opening 302 is between 1.3 and 4.0. Furthermore, the ratio of the distance between the inner opening 301 and the outer opening 302 to the diameter of the outer opening 302 may advantageously be between 0.25 and 1.4. If the diameter of the outer opening 302 is substantially small the thickness of the base surface 206 of the jet box limits the lower limit of the range of the ratio of the distance between the inner opening 301 and the outer opening 302 to the diameter of the outer opening 302. Because the both aforementioned ratios depend on the diameter of the outer opening 302 the diameter of the outer opening 302 is advantageously defined so that the ranges of the both aforementioned ratios may be fulfilled. For example in the field of veneer drying the diameter of the outer opening 302 is typically between 6 and 14 mm. It should be noted that the aforementioned ratios are advantageous examples for some jet nozzle structure. However, those ratios may not be valid with all diameter values of the outer opening 302, e.g., with small diameter values such as 6 mm the lower limits may be too low.

Figure 5:
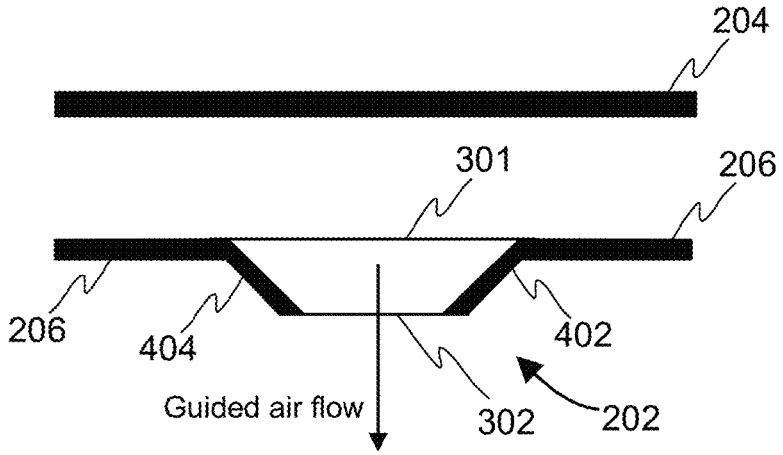
FIG. 5 illustrates schematically an example of cross-sectional view of a jet nozzle according to the invention as viewed in a B-B direction of FIGS. 4*a* and 4*b*.

The first portion of the guide surface 306 is between the first merging portion 402 and the second merging portion 404 and the second portion of the guide surface 304 between the first merging portion 402 and the second merging portion 404. The convexity of the first portion of the guide surface 306 may be at least partly constant and/or it may vary progressively at least partly. Similarly, the concavity of the second portion of the guide surface 304 may be at least partly constant and/or it may vary progressively at least partly. As an example, the convexity of the first portion of the guide surface 306 may vary progressively from the center of the first portion of the guide surface 306 to the merging portions 402, 404 and the concavity of the second portion of the guide surface 304 may vary progressively from the center of the second portion of the guide surface 304 to the merging portions 402, 404. FIG. 5 presents a cross-sectional view of the example of the jet nozzle 202 from another direction to show the merging portions 402, 404. The merging portions in FIG. 5 are slanted, but the merging portions may also be vertical i.e. travel substantially parallel to the air flow.

Figure 6:
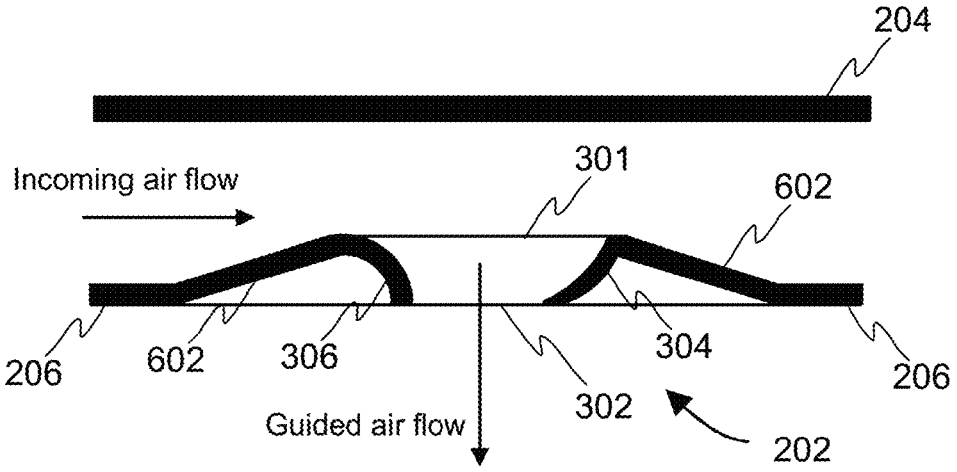
FIG. 6 illustrates schematically another example of a cross-sectional view of a jet nozzle solution according to the invention as viewed in a A-A direction of FIGS. 4*a* and 4*b*.
Figure 7:
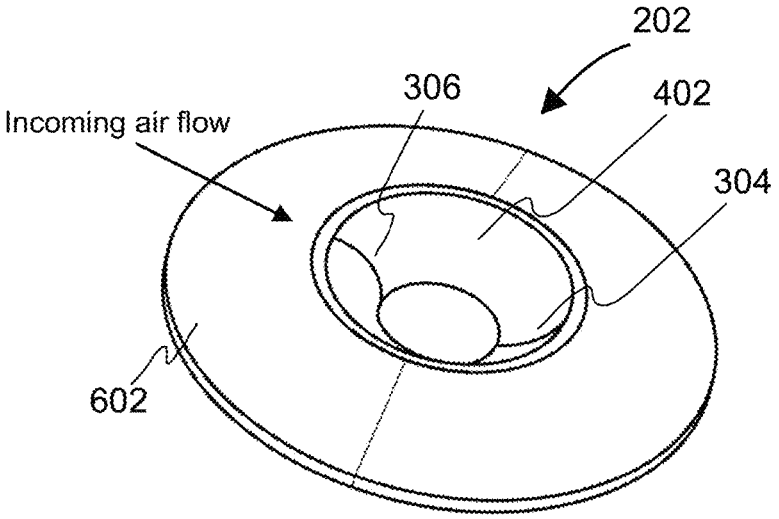
FIG. 7 illustrates an example of a 3D view of a jet nozzle according to the invention as viewed in FIG. 6.

Alternatively or in addition, the at least one jet nozzle 202 may be arranged on the base surface 206 of the jet box 200 so that the guide surface further comprises an intermediate portion of the guide surface 602 between the base surface 206 of the jet box 200 and the first portion 306, second portion 304, first merging portion 402, and second merging portion 404 of the guide surface. An example of such an implementation is illustrated in FIG. 6. The intermediate portion of the guide surface 602 may be bended at least partly inside or outside the jet box 200 so that the intermediate portion of the guide surface 602 diverges from the plane of the base surface 206 of the jet box 200. In order to reduce a risk that the veneer sheets stuck on the guide surface, the at least one jet nozzle 202 may be advantageously arranged so that the intermediate portion of the guide surface 602 is bended inside the jet box 200, as illustrated in FIGS. 6 and 7. In some embodiments the jet nozzles 202 may be arranged on the base surface 206 of the jet box 200 so that the intermediate portion of the guide surface 602 of some jet nozzles 202 are bended inside the jet box 200 and some outside the jet box 200.

Generally speaking the shape of the jet nozzle 202 is defined advantageously so that the air flow is not allowed to spread in the jet nozzle 202 and the turning of the air flow outside the jet box 200 is substantially perpendicular to the base surface 206 of the jet box 200. The air flow is advantageously configured to follow the convexly curved first portion of the guide surface 306 in order to arrange the flow of the air to a desired direction, i.e., the convexly curved first portion of the guide surface 306 turns the incoming air flow gradually perpendicular to the base surface 206 of the jet box 200. The concavely curved second portion of the guide surface 304 on a side of the incoming air flow enhances the turning of the incoming air flow direction. Hence, the air flow is configured to follow all the portions of the guide surface.

Separation of the air flow from the guide surface causes strong turbulence of the air that causes the air flow to spread in the jet nozzle 202, which in turn decreases the heat transfer and increases the pressure loss. Thus, the jet nozzle according to an embodiment of the invention is advantageously shaped so that the air flow is turned substantially perpendicular to the base surface 206 of the jet box 200 and the air flow is configured to follow all the portions of the guide surface.

The convex-concave shaping of the guide surface of the jet nozzle 202 turns the air flow parallel to the outer end of the convexly curved first portion of the guide surface 306, i.e., the convex-concave shaping turns the air flow substantially perpendicular to the base surface 206 of the jet box 200 against the veneer sheet. The convex shape of the first portion of the guide surface 306 enables substantially slow and gradual turning of the air flow compared to a straight or an oblique shape of the guide surface. Combined with the convex shape of the first portion of the guide surface 306 the concave shape of the second portion of the guide surface 304 causes that the air flow is accelerating from the inner opening 301 towards the outer opening 302 and turns the air flow gradually substantially perpendicular to the base surface 206 of the jet box 200. The inner end of the concavely curved second portion of the guide surface 304 separates the guided air flow from the incoming air flow more efficiently than other shapes of the second guide surface, e.g., a straight or an oblique shape of the guide surface. The combination of convex and concave shapes prevents, at least partly, that the air flow separates from the guide surface of the jet nozzle 202. The separation of the air flow from the guide surface is especially problem in the convexly curved first portion of the guide surface 306. The concavely curved second portion of the guide surface 304 enhances the air flow to follow the convexly curved first portion of the guide surface 306, because the concavely curved second portion of the guide surface 304 pushes the air flow against the convexly curved first portion of the guide surface when the air flow is propagating towards the outer opening 302.

Thus, both the convexly curved first portion of the guide surface 306 and the concavely curved second portion of the guide surface 304 enhance the turning of the air flow in a controlled manner substantially perpendicular to the base surface 206 of the jet box 200. Mere the convexly curved first portion of the guide surface 306 or mere the concavely curved second portion of the guide surface 304 alone is not sufficient. Turning of the air flow in a controlled manner means here that the air flow is turned so that the air flow does not separate from the guide surface of the jet nozzle 202.

The jet nozzle 202 according to the present invention enhances at least partly the heat transfer of the air flow travelling through the jet nozzle 202 against the veneer sheet. The air flows longitudinally inside the jet box 200 and the jet nozzle 202 guides the air flow direction substantially perpendicularly to the base surface 206 of the jet box 200 against the veneer sheet. By using the jet nozzle 202 shape according to the present invention the guiding of the air flow may be improved substantially. Because the jet nozzle 202 according to the invention arranges the flow of the air substantially perpendicularly to the base surface 206 of the jet box 200, the mutual disturbing of the guided air flows of the sequential jet nozzles 202 in the longitudinal direction of the jet box 200 may be at least partly decreased, which, in turn, enhances the heat transfer of the jet box 200. Advantageously, the distance between the veneer sheet and the jet nozzle 202 may be defined so that the ratio of the distance between the veneer sheet and the jet nozzle 202 to the diameter of the outer opening 302 is between 1.2 and 6.0.

Some of the advantages achieved with the jet nozzle 202 according to the present invention in comparison with the prior art solutions may be: the pressure loss caused by the jet nozzle 202 may be decreased; the turbulence of the air inside the jet nozzle 202 and on the surface of the veneer sheet may be decreased and thus the evenness of the air flow along the length of the jet box 200 may be improved; and with the same volume flow rate substantially more heat may be transferred to the veneer sheet. Therefore, by using the same volume flow rate as with the existing drying process the heat transfer may be enhanced and the pressure loss may be decreased. This enables increasing the power of the heating system and at the same time increasing the volume flow rate in order to enhance the heat to the veneer sheet and moisture transfer from the veneer sheet.

The jet nozzle 202 according to the invention may be manufactured on the base surface 206 of the jet box 200 so that the opening structure is provided by drilling, die-cutting, or cutting the base surface 206 of the jet box 200. The shape of the jet nozzle is pressed to the base surface 206 of the jet box 200 around the opening structure in one or two stages by means of tools made for the shape of the jet nozzle. Generally, the manufacturing is done in a sheet metal working facility.

The jet nozzle according to the invention is disclosed above as a fixed component of the jet box, but the nozzle may also be a discrete component that may be configured to be attached on the base surface of the jet box with, e.g., adhesive, solder, mechanical fixing or welding. In such a case applicable openings are arranged in the base surface into which the nozzle components may be installed and mounted.

Above the invention is mainly described in an implementation wherein the base surface 206 of the jet box 200 is arranged substantially parallel to the plane of the veneer sheet. However, the base surface 206 of the jet box 200 may alternatively be slanted in relation to the plane of the veneer sheet. For example the base surface 206 of the jet box 200 may be slanted in the transversal direction of the base surface 206 of the jet box 200 in relation to the plane of the veneer sheet. If the base surface 206 of the jet box 200 is slanted, the shape of the jet nozzles 202 is defined advantageously so that the plane defined by the outer opening 302 is substantially parallel to the plane of the veneer sheet in order to turn the incoming air flow substantially perpendicular to the veneer sheet. Alternatively or in addition, the base surface 206 of the jet box 200 may comprise multiple sub-base surfaces that may be arranged, e.g., stepwise with respect to each other, although it is described as a flat surface above.

Above it is described a jet box according to the present invention with different embodiments. Moreover, the present invention relates to a dryer for veneer production. The dryer comprises a blower, which is configured to generate air flow to be used in drying of the sheet-like objects, such as veneers. The dryer also comprises at least one jet box as described above.

Features described in the preceding description may be used in combinations other than the combinations explicitly described. Although functions have been described with reference to certain features, those functions may be performable by other features whether described or not. Although features have been described with reference to certain embodiments, those features may also be present in other embodiments whether described or not.

The invention claimed is:

1. A jet box for guiding an incoming air flow in drying of a veneer sheet, the jet box comprising:

at least one jet nozzle disposed on a base surface, the jet nozzle comprising a guide surface forming a three-dimensional opening structure, which is limited at a first end thereof to an inner opening and at a second end thereof to an outer opening, the guide surface comprising a first portion of the guide surface and a second portion of the guide surface, wherein the first portion of the guide surface on a side of the incoming air flow is convexly curved outwards from the jet box and the second portion of the guide surface on the opposite side of the opening structure in relation to the incoming air flow is concavely curved outwards from the jet box.

2. The jet box according to claim 1, wherein the first portion of the guide surface is configured to merge to the second portion of the guide surface gradually.

3. The jet box according to claim 1, wherein the first portion of the guide surface is configured to merge to the second portion of the guide surface so that the guide surface further comprises a first merging portion and a second merging portion between the first portion of the guide surface and the second portion of the guide surface.

4. The jet box according to claim 3, wherein the first merging portion is a planar surface or a line-like surface.

5. The jet box according to claim 3, wherein the second merging portion is a planar surface or a line-like surface.

6. The jet box according to claim 1, wherein the convexity of the first portion of the guide surface is at least partly constant and/or varies progressively at least partly.

7. The jet box according to claim 1, wherein the concavity of the second portion of the guide surface is at least partly constant and/or varies progressively at least partly.

8. The jet box according to claim 1, wherein the outer opening is circular, elliptical or oval.

9. The jet box according to claim 1, wherein the inner opening is circular, elliptical or oval.

10. The jet box according to claim 1, wherein the at least one jet nozzle is disposed on the base surface of the jet box so that the guide surface further comprises an intermediate portion, which is bent at least partly inside or outside the jet box so that the intermediate portion of the guide surface diverges from a plane of the base surface of the jet box.

11. The jet box according to claim 1, wherein the ratio of the diameter of the inner opening to the diameter of the outer opening is between 1.3 and 4.0 and the ratio of the distance between the inner opening and the outer opening to the diameter of the outer opening is between 0.25 and 1.4.

12. A dryer for veneer production, comprising:

a blower; and at least one of the jet box according to claim 1.

13. The jet box according to claim 4, wherein the second merging portion is a planar surface or a line-like surface.

* * * * *